US008453288B2

(12) United States Patent
Driesen et al.

(10) Patent No.: US 8,453,288 B2
(45) Date of Patent: Jun. 4, 2013

(54) TOOTHBRUSH, TOOTHBRUSH HEAD AND TOOTH CLEANING BRISTLE

(75) Inventors: Georges Driesen, Weilrod (DE); Ivo Kunath, Krongberg (DE); Ulrich Störkel, Wiesbaden (DE); Michael Schmid, Frankfurt am Main (DE)

(73) Assignee: Braun GmbH, Kronberg (DE)

( * ) Notice: Subject to any disclaimer, the term of this patent is extended or adjusted under 35 U.S.C. 154(b) by 78 days.

(21) Appl. No.: 11/763,848

(22) Filed: Jun. 15, 2007

(65) Prior Publication Data

US 2007/0289078 A1 Dec. 20, 2007

(30) Foreign Application Priority Data

Jun. 16, 2006 (DE) ..... 10 2006 027 756

(51) Int. Cl.
*A46D 1/00* (2006.01)

(52) U.S. Cl.
USPC ..... 15/207.2; 428/397

(58) Field of Classification Search
USPC ..... 15/207.2; 428/397, 400, 401
See application file for complete search history.

(56) References Cited

U.S. PATENT DOCUMENTS

| | | | | | |
|---|---|---|---|---|---|
| 1,773,969 | A | * | 8/1930 | Whitehead et al. | 264/177.13 |
| 2,434,533 | A | | 1/1948 | wurzburger | |
| 3,109,220 | A | * | 11/1963 | McKinney et al. | 442/196 |
| 3,239,865 | A | * | 3/1966 | Munt | 15/159.1 |
| 3,302,230 | A | | 2/1967 | Poppelman | |
| 3,344,457 | A | * | 10/1967 | Grobert | 15/207.2 |
| 4,726,806 | A | * | 2/1988 | Hukuba | 433/32 |
| 5,463,815 | A | * | 11/1995 | Fogle | 30/276 |
| 5,533,227 | A | | 7/1996 | Ito et al. | |
| 5,725,954 | A | | 3/1998 | Montsinger | |
| 5,933,906 | A | * | 8/1999 | Rackley | 15/167.1 |
| 5,985,450 | A | * | 11/1999 | Keller | 428/401 |
| 6,094,769 | A | * | 8/2000 | Driesen et al. | 15/207.2 |
| 6,138,314 | A | * | 10/2000 | Schiff et al. | 15/167.1 |

FOREIGN PATENT DOCUMENTS

| | | | |
|---|---|---|---|
| DE | 11 40 901 | | 12/1961 |
| DE | 1 997 717 | | 2/1968 |
| DE | 195 33 815 | | 3/1997 |
| DE | 198 18 345 | | 10/1999 |
| DE | 102 12 701 | | 10/2003 |
| EP | 0 329 505 | | 8/1989 |
| GB | 1 137 407 | | 12/1968 |
| JP | 6-217830 | * | 8/1994 |
| JP | 6-233709 | | 8/1994 |
| JP | 2003-144229 | * | 5/2003 |
| JP | 2005-253713 | * | 9/2005 |

* cited by examiner

*Primary Examiner* — Mark Spisich
(74) *Attorney, Agent, or Firm* — John P. Colbert

(57) ABSTRACT

The present invention relates to a tooth cleaning bristle, which is configured as a monofilament and has a outer surface having a contour that is structured preferably in the shape of a longitudinal flute and that has projections and depressions, alternating in the peripheral direction. The invention further relates to a toothbrush head having a bristle holder to which at least one such tooth cleaning bristle is fastened, and finally to a preferably electric toothbrush having such a toothbrush head.

10 Claims, 4 Drawing Sheets

TOOTHBRUSH, TOOTHBRUSH HEAD AND TOOTH CLEANING BRISTLE

TECHNICAL FIELD

The present invention relates to a tooth cleaning bristle. The invention further relates to a toothbrush head having a bristle holder to which at least one such tooth cleaning bristle is fastened, and finally to a preferably electric toothbrush having a toothbrush head of this kind.

BACKGROUND

Traditionally, for the bristle cluster of a toothbrush, substantially cylindrical tooth cleaning bristles are used, circular cylindrical bristles, in particular, but also cylindrical shapes having bases which are different from the circular shape, being known. Besides cylindrical tooth cleaning bristles of triangular, square or polygonal cross sections, tooth cleaning bristles having complicated contours on the outer surface have also recently been proposed, e.g. tooth cleaning bristles of star-shaped or cruciform cross sections.

U.S. Pat. No. 3,302,230 shows a toothbrush having bristles which taper in the longitudinal direction and which are designed to be of triangular, star-shaped or rhombic configuration in cross section in order to obtain a scraping effect with the outer surface contoured edges and to achieve an improved adhesion of the toothpaste compared to circular cross sections. JP 6-233709 A also proposes such angular cross-sectional contours for the tooth cleaning bristles of a toothbrush in order to effect better plaque removal by virtue of the outer surface edges and their scraping effect. DE 195 33 815 A1 proposes, on the other hand, a toothbrush whose bristles, on their outer surface, are designed to have a single-turn or multi-turn helix in order to obtain an enhanced massaging effect. Such helically twisted contours have the drawback, however, that the bristles can easily catch amongst themselves and, moreover, that penetration into interdental spaces is made more difficult, since the bristles would need to twist for this purpose.

From DE 198 18 345 A1, multilayered tooth cleaning bristles of non-homogeneous material cross section are known, in which a relatively hard plastic core is designed to be encased in an elastomeric plastic layer contoured by stamping against the core, longitudinal ribs which are distributed over the periphery and which give the bristle an altogether approximately flower-shaped cross section, or hole-shaped recesses in the outer surface, being proposed as the contouring. Such multilayered bristles are, however, complicated to produce and correspondingly expensive and, moreover, are only conditionally suited to fastening by the so-called anchor-plugging method. In order to increase the flexural rigidity of even long, very narrow bristles, DE 1 997 717 proposes constructing a bristle from a plurality of filaments which are bonded together along their longitudinally running contact surfaces, whereupon convexly curved longitudinal ribs are formed on the outer surface in the style of a flower stem bunch. Between the filaments forming the bristle, storage pockets are formed, in which moisture collects. Self-evidently, this bristle, too, which is bonded together from a plurality of filaments, is produced by complex means. In U.S. Pat. No. 5,533,227, a toothbrush is additionally described, the bristles of which are sharpened to a point at the bristle ends. Apart from these sharpenings, the bristles are, however, of circular cylindrical configuration.

Other bristles having outer surface contours for other purposes, however, are shown by the publications EP 0 329 505 B1, DE 11 40 901, U.S. Pat. No. 5,725,954, U.S. Pat. No. 2,434,533 and GB 1,137,407.

SUMMARY

In order to be able equally to meet the intrinsically divergent requirements demanded of a tooth cleaning bristle, the present invention provides a specific contour of the outer surface of the tooth cleaning bristles, which allows a simple filling of the bristle holder with a high bristle density, prevents catching of the bristles combined into a cluster, and yet ensures an intensive cleaning action of the outer surface. As a result of the contour, a ratio of the circumference of the tooth cleaning bristle to the cross-sectional area of the bristle can be chosen.

According to the invention, the tooth cleaning bristle configured as a monofilament has an outer surface contour which is configured such that the ratio of the circumference of the outer surface to the cross-sectional area of the tooth cleaning bristle is in a range from about 30 $mm^{-1}$ to about 50 $mm^{-1}$. The outer surface of the tooth cleaning bristle is hence significantly enlarged in relation to a circular cylindrical bristle of comparable cross-sectional area, so that the cleaning action of the outer surface is correspondingly improved and toothpaste adheres better to the tooth cleaning bristle on the outer surface and is delivered better. In the outer surface depressions of the contour, toothpaste can be received and, upon cleaning contact with the teeth, directly delivered, whereby a greater polishing effect is achieved, which is desirable, in particular, in the removal of tooth discoloration. As a result of the enlarged outer surface, which is obtained despite the small cross-sectional area compared to round bristles, more cleaning area is engaged with the teeth to be cleaned, thereby resulting in an enhanced cleaning performance. Moreover, a thus configured contour of the outer surface of the tooth cleaning bristle allows a high bristle density given a constant bristle arrangement in a cluster, without sacrificing space between the bristles. Nonetheless, in spite of the outer surface contour, the tooth cleaning bristle remains suitable for fastening to a corresponding bristle holder by anchor-plugging methods. A multiplicity of tooth cleaning bristles with essentially double the cluster length can be bent together in a U-shape to form a cluster and anchored in a cluster-receiving recess in the bristle holder by means of an anchor lying over the bend in the bristles. An anchorless plugging, using, for example, the so-called AFT or IAP method, is likewise conceivable with these bristles.

Preferably, the outer surface contour of the tooth cleaning bristle is configured such that said circumference/cross-sectional area ratio is in a range of about 30 $mm^{-1}$ to about 40 $mm^{-1}$, in particular about 32 $mm^{-1}$ to about 36 $mm^{-1}$. As a result, still better allowance is made for the aforesaid divergent requirements.

In an embodiment of the invention, the circumference or peripheral length of the contoured outer surface, measured along the projections and depressions of the outer surface, is in a range from about 0.5 mm to about 1 mm, the contour advantageously being configured such that the circumference is in a range from about 0.6 mm to about 0.8 mm. Despite this relatively high circumference, the cross-sectional area can advantageously be kept small, preferably in a range of about 0.01 $mm^2$ to about 0.03 $mm^2$, or about 0.015 $mm^2$ to about 0.020 $mm^2$. By virtue of the small cross-sectional area of the individual tooth cleaning bristles, a high packing density with a large number of bristles per unit of area of the bristle holder can be achieved. Moreover, the tooth cleaning bristles can be easily bent in a U-shape in the desired manner in order to be fastened to the bristle holder by anchor-plugging methods.

The depressions and projections of the contour can here be configured and arranged fundamentally differently. According to an advantageous embodiment of the invention, the projections and depressions are evenly distributed over the periphery or circumference of the outer surface of the tooth cleaning bristle. The depressions and projections can be arranged such that an inner envelope circle is defined by the depressions and an outer envelope circle is defined by the projections, i.e. the radially deepest points of the depressions lie on a circle, just as the radially outermost points of the projections lie on a circle. Oval, elliptical or generally non-circular envelope curves may also be considered. Preference is given, however, to the aforesaid configuration comprising an arrangement of depressions and projections which defines envelope circles, with which arrangement the aforesaid divergent requirements regarding the nature of a tooth cleaning bristle cluster can be met.

In an embodiment of the invention, the depth of the depressions and the height of the projections are chosen such that the ratio of the diameter of the outer envelope circle defined by the projections to the diameter of the inner envelope circle defined by the depressions lies in a range from about 1.1 to about 1.6, preference being given to different values of the diameter ratio, depending on the geometry of the depressions and projections.

The number of depressions and projections of the outer surface contour which are distributed over the periphery can be chosen. At least four depressions and four projections may be distributed over the periphery in order to achieve a sufficient enlargement of the circumference without cross-sectional incisions of too great a depth. In an embodiment of the invention, at least six depressions and at least six projections are provided on the outer surface of the tooth cleaning bristle.

According to a preferred embodiment of the invention, the tooth cleaning bristle configured as a monofilament can be provided with a cross section which is substantially flower-shaped or has the shape of a multi-lobed clover leaf. The projections, viewed in cross section, have an arc-shaped, in particular circular-arc-shaped contour, while the depressions, likewise viewed in cross section, have a V-shaped or pointed contour, formed by the converging side walls of two respectively adjacent projections. The depressions have a configuration, in the form of convergent columns, with the side walls of the adjacent projections converging to a point or such that they are rounded off with just a small radius. Depending on the degree of convexity of the projections, the side walls can converge in the depressions at different angles, the contour preferably being configured such that the side walls of two adjacent projections converge at an acute angle, advantageously at an angle of less than 60°.

In particular in such a configuration of the outer surface contour having depressions converging inwards to a point, the aforesaid diameter ratio of outer envelope circle to inner envelope circle can lie in a range from about 1.4 to about 1.6 and, according to an advantageous embodiment of the invention, can be about 1.5.

In a flower-shaped or clover-leaf-shaped configuration of the cross section of the tooth cleaning bristle, it proves particularly advantageous if, on the outer surface, six projections and six depressions are provided, which extend in the form, respectively, of longitudinal ribs and longitudinal depressions, advantageously parallel to the longitudinal axis of the tooth cleaning bristle.

By virtue of the longitudinal ribs of arc-shaped marginal contour, an efficient and nonetheless gentle tooth cleaning can be achieved also with the outer surfaces of the tooth cleaning bristles.

In order to achieve a stronger abrasive effect with the outer surface of the tooth cleaning bristles, the tooth cleaning bristle, according to an alternative, likewise preferred embodiment of the invention, can have a cross section which is roughly like a splined shaft and in which, on the outer surface of the tooth cleaning bristle, in the peripheral direction, crenelated projections alternate with approximately U-shaped depressions or grooves. The crenelated contour of the projections can advantageously have slightly inclined side walls, so that the crenelated projections slightly taper radially outwards. The connecting portion of the crenelated contour, connecting the preferably straight side walls, can have a basically flat configuration, yet, in an embodiment of the invention, is slightly convexly curved, an angular transition of the top-side-forming connecting portion into the side walls being advantageously provided. The depressions provided between the crenelated projections are delimited by said side walls of the crenelated contours, which, however, in contrast to the previously described embodiment, are spaced apart, so that a blunt base is formed between the side walls and the depression has a U-shaped cross section. In particular, the contour can be configured such that the outer surface of the tooth cleaning bristle corresponds to a circular cylindrical shaft, into the periphery of which longitudinal grooves are milled.

In such a configuration of the tooth cleaning bristle with U-shaped depressions, which configuration is like a splined shaft, said depressions advantageously have a very flat configuration. In an embodiment of the invention, the diameter ratio of the aforesaid outer envelope circle to the inner envelope circle is in a range of about 1.1 to about 1.2. Preferably, on the outer surface, eight projections are provided, which alternate with eight U-shaped depressions.

Preferably, the tooth cleaning bristles have a cross section which is essentially constant over the length of the tooth cleaning bristles, so that the projections and depressions of the contour form a pattern that extends substantially over the entire length of the bristle. Where necessary, the tooth cleaning bristle can be rounded or otherwise tapered toward its bristle end, so that a constant cross section is no longer present in this bristle end portion.

In an embodiment of the invention, the contour of the outer surface is not twisted. The tooth cleaning bristle, in particular in the region of the contoured outer surface, can, where necessary, apart from a bristle end portion, have an altogether cylindrical configuration, in which case the base, due to the contour, is not of course circular, but is correspondingly contoured.

The tooth cleaning bristles described herein exhibit flexural rigidity that can be substantially independent of direction. Contours on the outer surfaces of these bristles provide recesses for receiving toothpaste and may effect good plaque removal by virtue of the scraping effect of their outer surface edges. In addition, the inventive tooth cleaning bristles can be readily formed into high-density clusters with reduced space between the bristles and without catching on contours of adjacent bristles. The bristles may also easily bent in a U-shape for fastening to a bristle holder of a toothbrush head by the anchor-plugging method.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
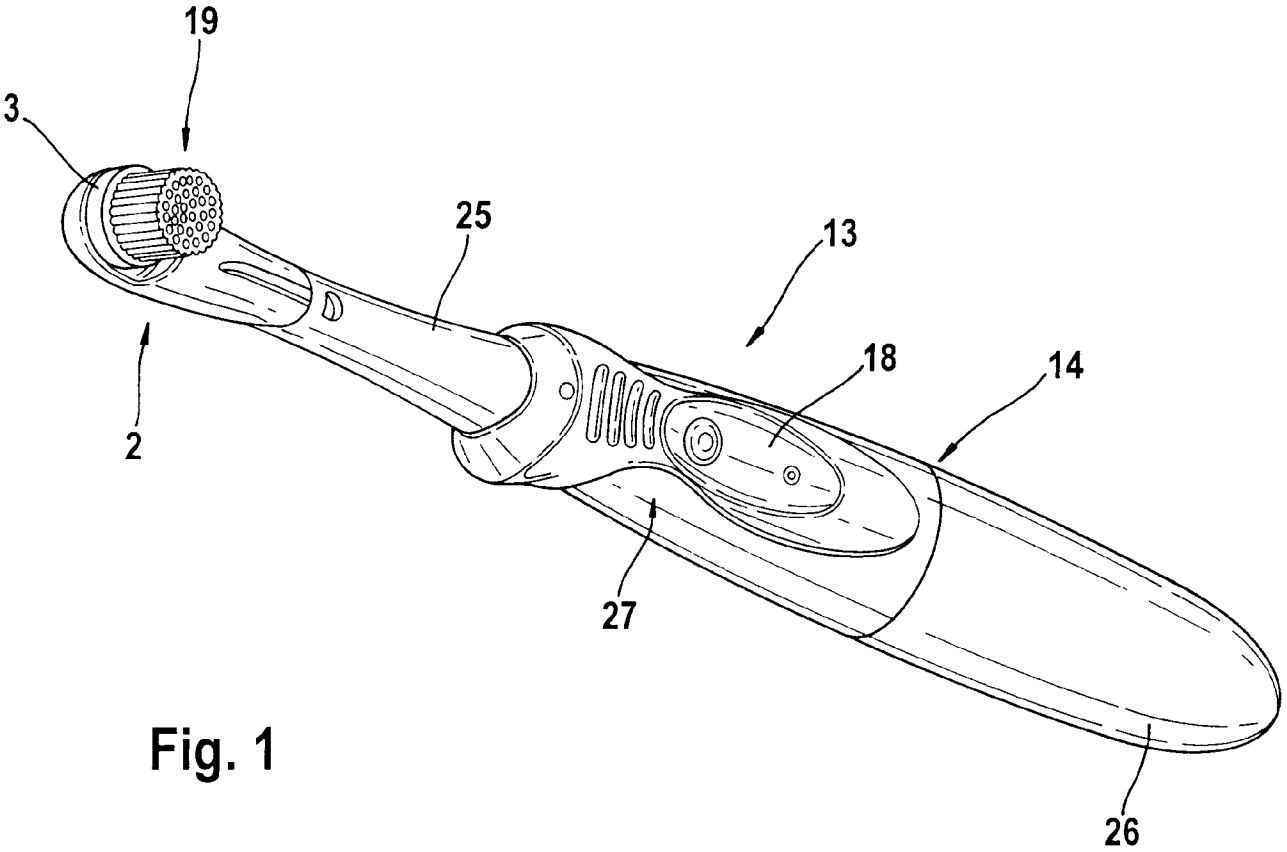
FIG. 1 shows a perspective view of an electric toothbrush according to a preferred embodiment of the invention, which has a brush head with a rotary drivable bristle field.

The toothbrush 13 shown in FIG. 1 comprises a handle 14 and a toothbrush head 2 which is seated on a brush tube 25 forming a front end of, connected to, or removably coupled to the handle 14. The handle 14 is formed by a toothbrush housing 26, in which a battery compartment and a drive motor 27 are disposed axially one behind the other. The drive motor 27 can be switched on and off by means of a switch 18. Via a drive train (not shown), comprising a gear mechanism and a transducer extending through the brush tube 25, the disk-shaped bristle holder 3 of the toothbrush head 2 can be driven in a rotationally oscillating manner. In the illustrated embodiment, a bristle field 19 is seated on the bristle holder 3. The bristle field has a substantially circular cylindrical configuration and can include a multiplicity of bristle clusters 4, as shown by FIG. 2.

Figure 2:
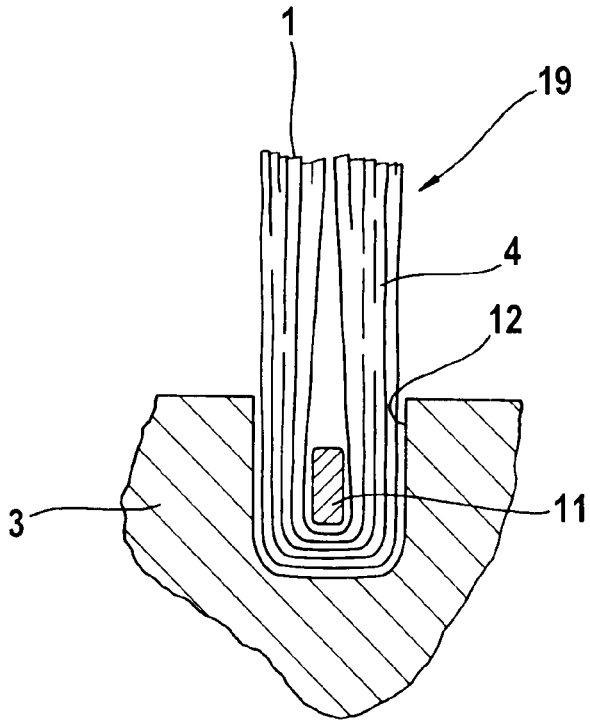
FIG. 2 shows a schematic representation of a bristle cluster including filaments bent in a U-shape, which is accommodated in a cluster-receiving recess and is fastened with an anchor lying over the bend in the filaments.

The bristle cluster 4 shown in FIG. 2 is advantageously fastened to the bristle holder 3 by so-called anchor-plugging methods. The bristle holder 3 has for this purpose a substantially cylindrical, blind hole-shaped cluster-receiving recess 12, in which the bristle cluster 4 is held. The bristle cluster 4 here comprises a multiplicity of tooth cleaning bristles 1 bent in a U-shape, which essentially have double the length of the bristle cluster 4, so that each tooth cleaning bristle 1 sits in the shape of a loop in the receiving recess 12 and forms with its two side pieces in fact two bristles in the bristle cluster 4. As shown by FIG. 2, over the bend of tooth cleaning bristle 1 there is placed an anchor 11, with the aid of which the bristle cluster 4 is anchored in the cluster-receiving recess 12. The anchor 11 here extends transversely over the receiving recess 12 and can be driven in the wall thereof.

Figure 3:
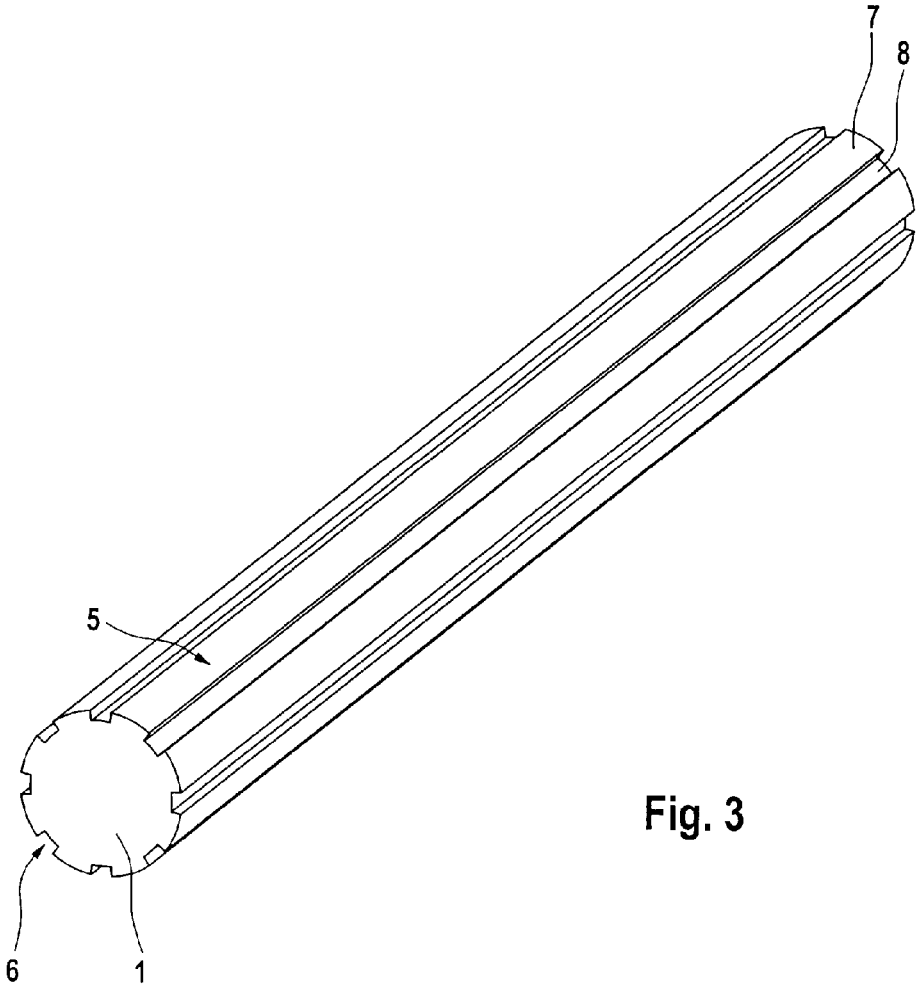
FIG. 3 shows a schematic, perspective representation of a tooth cleaning bristle of the toothbrush from FIG. 1 according to a first preferred embodiment.

According to a first advantageous embodiment of the invention, the tooth cleaning bristles 1 advantageously have the contour shown in FIG. 3. Each tooth cleaning bristle 1 is here configured as a monofilament and is produced from a polymer material, in particular polyamide, PBT (polybutylene terephthalate) or a thermoplastic elastomer, other materials, too, in principle being usable. By virtue of the monofil configuration, the tooth cleaning bristle 1 has a substantially homogeneous material cross section.

As shown by FIG. 3, the tooth cleaning bristle 1 advantageously has an altogether cylindrical shape, in the illustrated embodiment a cross section being provided which is constant over the length of the tooth cleaning bristle 1. On the outer surface 5 of the tooth cleaning bristle 1 there is provided a contour 6, which in the illustrated embodiment has a course running axially parallel to the longitudinal axis of the tooth cleaning bristle 1.

Figure 4:
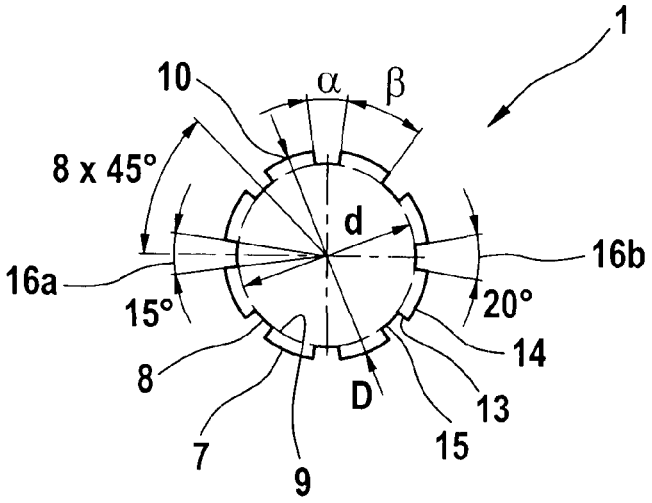
FIG. 4 shows a cross section through the tooth cleaning bristle from FIG. 3.

As jointly shown by FIGS. 3 and 4, the contour 6 of the outer surface 5 substantially corresponds to a splined shaft contour, which in the illustrated embodiment has an eight-grooved configuration. In the peripheral direction, dentate or crenelated projections 7 alternate with depressions 8 of U-shaped cross section, the depressions 8 forming all in all axially parallel grooves in the outer surface 5 and the projections 7 forming axially parallel ribs.

As shown by FIG. 4, the projections 7 have in the peripheral direction a somewhat greater width than the depressions 8. The crenelated projections 7 are laterally delimited by straight side walls 13, while the raised top side of the projections 7, which forms a connecting portion 14 between the side walls 13 of the respective projection 7, has a slightly convex configuration. Said top sides of the projections 7 here respectively have the shape of a circular cylindrical segment and lie on a joint outer envelope circle 10 or an outer envelope cylinder, the diameter of which is labeled in FIG. 4 with the reference symbol D. The depressions 8 provided between the projections 7 form axially parallel grooves of U-shaped cross section, having a planar or, alternatively, slightly convex bottom 15, the bottoms 15 of all the depressions 8 lying together on an inner envelope circle 9 or an inner envelope cylinder, the diameter of which is labeled in FIG. 4 with the reference symbol d.

As shown by FIG. 4, the depressions 8 widen slightly radially outwards. The side walls 13 of the projections 7, which laterally delimit the depressions 8, are slightly inclined one to the other at an acute angle, preferably at an angle 16*a* of about 10° to 30°, preferably about 15°. While the angle 16*a* describes the "apex angle" directly between the inner points of intersection of the side wall 13 and the surface line of the depression, the greater angle 16*b* (about 20°) indicates the apex angle between the outer points of intersection of the side wall and the surface line of the projections.

The angle $\alpha$ (16*a*) in FIG. 4, which describes the angular range of the depressions in terms of their angular extent, is in any event less than the angle $\beta$, which describes the angular range of the angular extent of the projections. Preferably, a ratio of $\alpha$ to $\beta$ is about 1 to 2.

In the illustrated embodiment, the depth of the depressions 8 is chosen such that the ratio of the aforesaid diameter D of the outer envelope circle 10 to the diameter d of the inner envelope circle 9 in the illustrated embodiment is about 1.15.

In the illustrated embodiment, eight depressions 8 and eight projections 7 are provided, with the depressions 8 and the projections 7 being evenly distributed over the periphery of the outer surface 5 respectively at a dividing angle of 45°.

In concrete terms, the diameter D of the outer envelope curve 10 in the illustrated embodiment is about 6.25 mil, equivalent to about 0.1587 mm, while the diameter d of the inner envelope curve 9 is about 5.5 mil, equivalent to about 0.1397 mm.

For the illustrated embodiment, this produces a circumference of about 0.60 mm to about 0.65 mm and a cross-sectional area of about 0.015 $mm^2$ to about 0.20 $mm^2$, so that the ratio of the circumference to the cross-sectional area is about 34 $mm^{-1}$ to about 35 $mm^{-1}$.

Figure 5:
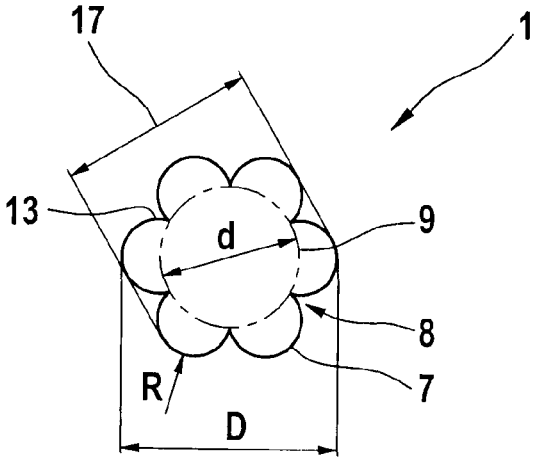
FIG. 5 shows a cross section through a tooth cleaning bristle according to an alternative embodiment of the invention.

Alternatively to the cross-sectional area shown in FIG. 4, the tooth cleaning bristle can also have an approximately flower-shaped cross section or a cross section which approximately corresponds to the contour of a multi-lobed clover leaf, as shown by FIG. 5. The axially parallel projections 7 have in cross section a circular-arc-shaped outer contour, which is dimensioned and arranged such that respectively semicircular arc segments are placed adjacent to each other around the periphery. In this embodiment, the depressions 8 are formed by the pointedly converging side walls 13, so that the depressions 8 have an approximately V-shaped contour, while the walls have a curvature. In the illustrated embodiment, the side walls 13 of two adjacent projections 7 meet at an angle of about 45°.

As shown by FIG. 5, six such projections 7 of circular-segment-shaped cross section are evenly distributed over the periphery at a dividing angle of 60°, the projections 7 being evenly arranged also in the radial direction, so that with their respectively maximum radial extent they define an outer envelope circle 10, the diameter of which, in FIG. 5, is once again labeled with the reference symbol D. The depressions 8 define the inner envelope circle 9, the diameter of which is labeled in FIG. 5 with the reference symbol d.

The outer contour of the projections 7, which is rounded in cross section in the shape of a circular arc, is rounded with a radius of curvature of about 0.02 mm to about 0.03 mm, in the illustrated embodiment a rounding radius 16 of about 0.026 mm being provided. Together with the even distribution of the six projections 7, this produces a diameter D of the outer envelope circle 10 of about 6.58 mil, equivalent to about 0.167 mm. The diameter d of the inner envelope circle 9, which is defined by the depressions 8, amounts in the illustrated embodiment to about 4.34 mil, equivalent to about 0.11 mm. The minimum outer diameter 17, which is obtained by a measurement in the manner shown in FIG. 5, is about 5.5 mil to about 6.5 mil, in particular about 6 mil, equivalent to about 0.152±0.013 mm.

The diameter ratio of the outer envelope circle 10 to the inner envelope circle 9 in the illustrated embodiment is about 1.5.

By virtue of the arc-shaped projections 7 of the contour 6, the circumference is significantly enlarged relative to a circular cross section with the same cross-sectional area. For a flower-shaped cross-sectional contour of this kind, the circumference is advantageously about 0.575 mm to about 0.675 mm, combined with a cross-sectional area of about 0.013 $mm^2$ to about 0.023 $mm^2$. In concrete terms, in the illustrated embodiment, a circumference of about 0.625 mm is obtained with a cross-sectional area of about 0.018 $mm^2$. Thus, the ratio of the circumference to the cross-sectional area is in a range of about 34 $mm^{-1}$ to about 35 $mm^{-1}$.

The tooth cleaning bristle can be used in manual toothbrushes and electric toothbrushes with sonic drive, oscillation drive or with eccentric balance drive.

A number of embodiments of the invention have been described. Nevertheless, it will be understood that various modifications may be made without departing from the spirit and scope of the invention. Accordingly, other embodiments are within the scope of the following claims.

What is claimed is:

1. A tooth cleaning bristle comprising a monofilament with a solid cross-sectional area with an outer surface having a contour along at least a portion of a length of the monofilament, wherein the contour defines alternating projections and depressions about a periphery of the monofilament, each of the projections are laterally delimited by a pair of straight side walls while a raised top side of each projection between between the respective side walls has a slightly convex configuration, each of the depressions being U-shaped and being defined by the side walls of adjacent projection and a bottom extending between the respective side walls, each of the projections further have in the peripheral direction a somewhat greater width than the depressions, wherein a ratio of a circumference of the outer surface of the monofilament to a cross-sectional area of the monofilament is in a range from about 34 $mm^{-1}$ to about 35 $mm^{-1}$ and further wherein an inner envelope circle is defined by the depressions and an outer envelope circle is defined by the projections, and wherein a ratio of the outer envelope circle to a diameter of the inner envelope circle is in a range from about 1.1 to about about 1.2.

2. The tooth cleaning bristle of claim 1, wherein the contour defines at least four depressions and at least four projections distributed over the periphery of the outer surface of the monofilament.

3. The tooth cleaning bristle of claim 1, wherein the contour defines at least six depressions and at least six projections distributed over the periphery of the outer surface of the monofilament.

4. The tooth cleaning bristle of claim 1, wherein the contour defines at least eight depressions and at least eight projections distributed over the periphery of other outer surface of the monofilament.

5. The tooth cleaning bristle of claim 1, wherein the projections when viewed in cross section have a crenelated contour.

6. The tooth cleaning bristle of claim 1, wherein the projections when viewed in cross section have a convexly curved top connecting the side walls.

7. The tooth cleaning bristle of claim 1, wherein the depressions have substantially the same shape and dimensions.

8. The tooth cleaning bristle of claim 1, wherein the depressions and the projections are substantially parallel to a longitudinal axis of the tooth cleaning bristle.

9. The tooth cleaning bristle of claim 1, wherein the contour of the outer surface of the monofilament is fluted.

10. A toothbrush head, comprising:

a bristle holder; and at least one toothbrush bristle fastened to the bristle holder wherein the toothbrush bristle comprises a monofilament with a solid cross-sectional area with an outer surface having a contour along at least a portion of a length of the monofilament, wherein the contour defines alternating projections and depressions about a periphery of the monofilament, each of the projections are laterally delimited by a pair of straight side walls while a raised top side of each projection between the respective side walls has a slightly convex configuration, each of the depressions being U-shaped and being defined by the side walls of adjacent projection and a bottom extending between the respective side walls, each of the projections further have in the peripheral direction a somewhat greater width than the depressions, wherein a ratio of a circumference of the outer surface of the monofilament to a cross-sectional area of the monofilament is in a range from about 34 $mm^{-1}$ to about 35 $mm^{-1}$ and further wherein an inner envelope circle is defined by the depressions and an outer envelope circle is defined by the projections, and wherein a ratio of the outer envelope circle to a diameter of the inner envelope circle is in a range from about 1.1 to about about 1.2.

* * * * *